US007628228B2

(12) United States Patent
Drivdahl et al.

(10) Patent No.: US 7,628,228 B2
(45) Date of Patent: Dec. 8, 2009

(54) CORE DRILL BIT WITH EXTENDED CROWN HEIGHT

(75) Inventors: K. Shayne Drivdahl, Park City, UT (US); Michael D. Rupp, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 68 days.

(21) Appl. No.: 11/610,680

(22) Filed: Dec. 14, 2006

(65) Prior Publication Data

US 2008/0142262 A1 Jun. 19, 2008

(51) Int. Cl.
*E21B 10/02* (2006.01)
*E21B 10/48* (2006.01)

(52) U.S. Cl. ..... 175/58; 175/403; 175/405.1

(58) Field of Classification Search ..... 175/20, 175/58, 403, 405.1
See application file for complete search history.

(56) References Cited

U.S. PATENT DOCUMENTS

| | | | | |
|---|---|---|---|---|
| 2,966,949 | A | 1/1961 | Wepsala, Jr. | |
| RE26,669 | E * | 9/1969 | Henderson | 175/405.1 |
| 4,128,136 | A | 12/1978 | Generoux | |
| 4,208,154 | A | 6/1980 | Gundy | |
| 4,499,959 | A | 2/1985 | Grappendorf | |
| 5,025,871 | A | 6/1991 | Stewart | |
| 5,069,584 | A * | 12/1991 | Obermeier et al. | 408/145 |
| 5,316,416 | A | 5/1994 | Kim | |
| 5,628,376 | A * | 5/1997 | Kleine | 175/403 |
| 5,823,276 | A * | 10/1998 | Beck, III | 175/405.1 |
| 5,836,409 | A | 11/1998 | Vail, III | |
| 5,932,508 | A | 8/1999 | Armstrong et al. | |
| 6,595,844 | B1 * | 7/2003 | Mizuno et al. | 451/540 |
| 2005/0016775 | A1 * | 1/2005 | Hiranuma et al. | 175/403 |
| 2007/0246266 | A1 * | 10/2007 | Larbo | 175/434 |

FOREIGN PATENT DOCUMENTS

| | | |
|---|---|---|
| WO | WO 0192677 A1 * | 12/2001 |
| WO | WO 2006/004494 | 1/2006 |
| WO | WO2006004494 | 1/2006 |
| WO | WO 2006/076795 | 7/2006 |

* cited by examiner

*Primary Examiner*—Shane Bomar
(74) *Attorney, Agent, or Firm*—Workman Nydegger

(57) ABSTRACT

Core drill bits with long crown heights are described herein. The core drill bits have a series of slots or openings that are not located at the tip of the crown and are therefore enclosed in the body of the crown. The slots may be staggered and/or stepped throughout the crown. As the cutting portion of the drill bit erodes through normal use, the fluid/debris notches at the tip of the bit are eliminated. As the erosion progresses, the slots become exposed and then they function as fluid/debris ways. This configuration allows the crown height to be extended and lengthened without substantially reducing the structural integrity of the drill bit.

9 Claims, 6 Drawing Sheets

Drill #2

Drill #1

CORE DRILL BIT WITH EXTENDED CROWN HEIGHT

FIELD

This application relates generally to drill bits and methods of making and using such drill bits. In particular, this application relates to core drill bits with an extended crown height and methods of making and using such drill bits.

BACKGROUND

Often, core drilling processes are used to retrieve a sample of a desired material. The core drilling process connects multiple lengths of drilling rod together to form a drill string that can extend for miles. The drill bit is located at the very tip of the drill string and is used to perform the actual cutting operation. As a core drill bit cuts its way through the desired material, cylindrical samples are allowed to pass through the hollow center of the drill bit, through the drill string, and then can be collected at the opposite end of the drill string.

Many types of core drill bits are currently used, including diamond-impregnated core drill bits. This drill bit is generally formed of steel or a matrix containing a powdered metal or a hard particulate material, such as tungsten carbide. This material is then infiltrated with a binder, such as a copper alloy. As shown in FIG. 1, the cutting portion 202 of the drill bit 200 (the crown) is impregnated with synthetic diamonds, natural diamonds, or super-abrasive materials (e.g., polycrystalline diamond). As the drill bit grinds and cuts through various materials, the cutting portion 202 of the drill bit 200 erodes, exposing new layers of the sharp natural or synthetic diamond, or other super abrasive materials.

The drill bit may continue to cut efficiently until the cutting portion of the drill bit is totally consumed. At that point, the drill bit becomes dull and must be replaced with a new drill bit. This replacement begins by removing (or tripping out) the entire drill string out of the hole that has been drilled (the borehole). Each section of the drill rod must be sequentially removed from the borehole. Once the drill bit is replaced, the entire drill string must be assembled section by section and then tripped back into the borehole. Depending on the depth of the hole and the characteristics of the materials being drilled, this process may need to be repeated multiple times for a single borehole. As a result, drill bits that last longer need to be replaced less often.

The crown heights for these drill bits are often limited by several factors, including the need to include fluid/debris ways 206 in the crown shown in FIG. 1. These fluid/debris ways serve several functions. First, they allow for debris produced by the action of the bit to be removed. Second, they allow drilling muds or fluids to be used to lubricate and cool the drill bit. Third, they help maintain hydrostatic equilibrium around the drill bit, preventing fluids and gases from the material being drilled from entering the borehole and causing blow out.

These fluid/debris ways are placed in the tip of the cutting portion of the core drill bit. Because the cutting portion of the core drill bit rotates under pressure, it can lose structural integrity because of the gaps 208 in the crown and then become susceptible to vibration, cracking, and fragmentation. To avoid these problems, the crown height of diamond-impregnated core drill bits is typically limited to heights of 16 to 17 millimeters or less. But with these shorter heights, though, the drill bits need to be replaced often because they wear down quickly.

SUMMARY

Core drill bits with extended crown heights are described in this patent application. The core drill bits have a series of slots or openings that are not located at the tip of the crown and are therefore enclosed in the body of the crown. The slots may be staggered and/or stepped throughout the crown. As the cutting portion of the drill bit erodes through normal use, the fluid/debris notches at the tip of the bit are eliminated. As the erosion progresses, the slots become exposed and then they function as fluid/debris ways. This configuration allows the crown height to be extended and lengthened without substantially reducing the structural integrity of the drill bit. And with an extended crown height, the drill bit can last longer and require less tripping in and out of the borehole to replace the drill bit.

BRIEF DESCRIPTION OF THE DRAWINGS

The following description can be better understood in light of Figures, in which.

Figure 1:
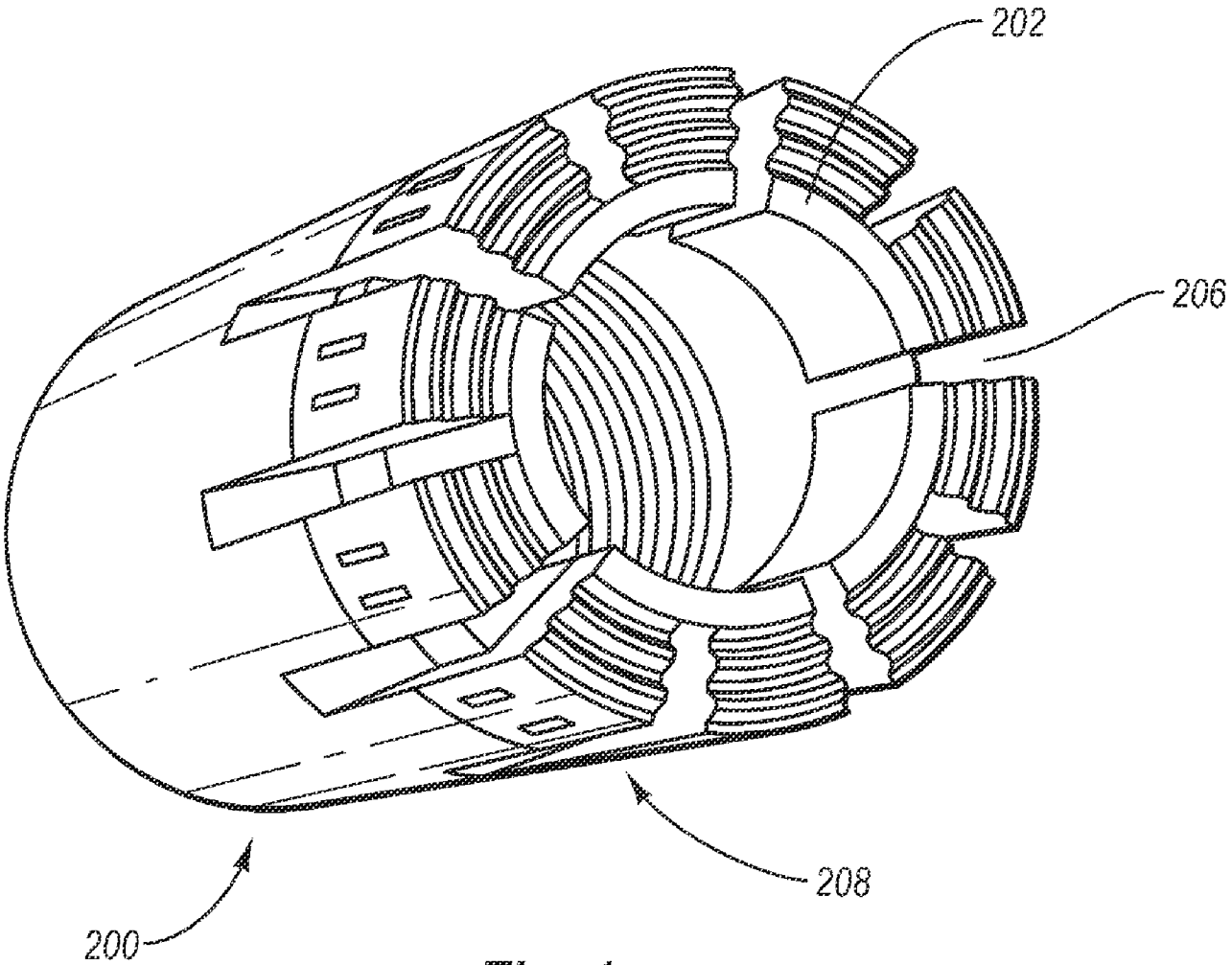
Fig. 1 (Prior Art)
FIG. 1 illustrates a conventional core drill bit.

Together with the following description, the Figures demonstrate and explain the principles of the apparatus and methods for using the apparatus. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any apparatus and techniques conventionally used in the industry. For example, while the description below focuses on an extended crown height for diamond-impregnated core drill bits, the apparatus and associated methods can be equally applied in carbide, ceramic, or other super-abrasive core drill bits. Indeed, the apparatus and associated methods may be implemented in many other in ground drilling applications such as navi-drills, full hole drills, and the like.

Figure 2:
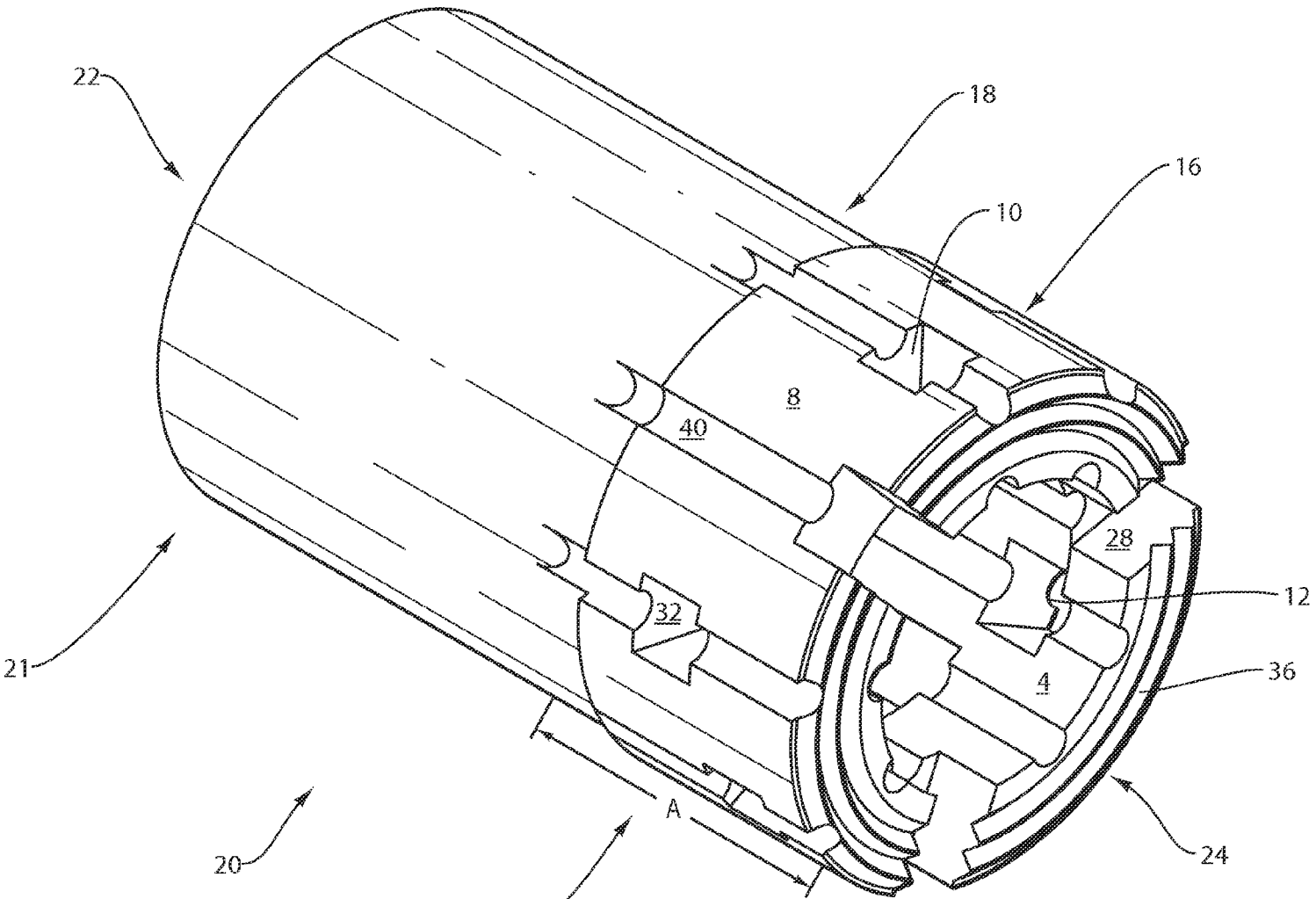
FIG. 2 illustrates an exemplary view of a core drill bit with an extended crown.

Core drill bits that maintain their structural integrity while extending the length or height of the crown are described below. One example of such a core drill bit is illustrated in FIG. 2. As shown in FIG. 2, the drill bit 20 contains a first section 21 that connects to the rest of the drill (i.e., a drill rod). The drill bit 20 also contains a second section 23 that is used to cut the desired materials during the drilling process. The body of the drill bit has an outer surface 8 and an inner surface 4 that contains a hollow portion therein. With this configuration, pieces of the material being drilled can pass through the hollow portion and up through the drill string.

The drill bit 20 may be any size, and may therefore be used to collect core samples of any size. While the drill bit may have any diameter and may be used to remove and collect core samples with any desired diameter, the diameter of the drill bit generally ranges from about 1 to about 12 inches. As well, while the kerf of the drill bit (the radius of the outer surface minus the radius of the inner surface) may be any width, it generally ranges from about ½ to about 6 inches.

The first section of the drill bit 20 may be made of any suitable material. In some embodiments, the first section may be made of steel or a matrix casting with a hard particulate material in a binder. Examples of the hard particulate material include those known in the art, as well as tungsten carbide, W, Fe, Co, Mo, and combinations thereof. Examples of a binder that can be used include those known in the art, as well as copper alloys, Ag, Zn, Ni, Co, Mo, and combinations thereof In some embodiments, the first section 21 may contain a chuck end 22 as shown in FIG. 2. This chuck end 22, sometimes called a blank, bit body, or shank, may be used for any purpose, including connecting the drill bit to nearest the drill rod. Thus, the chuck end 22 can be configured as known in the art to connect the drill bit 20 to any desired type of drill rod. For example, the chuck end 22 may include any known mounting structure for attaching the drill bit to any conventional drill rod, e.g., a threaded pin connection used to secure the drill bit to the drive shaft at the end of a drill string.

In the embodiments illustrated in FIG. 2, the second section 23 of the core drill bit 20 may comprise a cutting portion (or cutting end) 24. The cutting portion 24, often called the crown, may be constructed of any material(s) known in the art. For example, in some embodiments, a powder of tungsten carbide, boron nitride, iron, steel, Co, Mo, W, and/or a ferrous alloy may be placed in a mold. The powder may then be sintered and infiltrated with a molten binder, such as a copper, iron, Ag, Zn, or nickel alloy, to form the cutting portion.

In some embodiments, the second section 23 of the drill bit may be made of one or more layers. For example, FIG. 2 illustrates that the cutting portion 24 may contain two layers: a matrix layer 16 that performs the cutting operation and a backing layer 18, which connects the matrix layer to the second section of the drill bit. In these embodiments, the matrix layer 16 may contain a cutting media which abrades and erodes the material being drilled. Any cutting media may be used in the matrix layer 16, including natural or synthetic diamonds (e.g., polycrystalline diamond compacts). In some embodiments, the cutting media may be embedded or impregnated into the matrix layer 16. And any size, grain, quality, shape, grit, concentration, etc. of cutting media may be used in the matrix layer 16 as known in the art.

The cutting portion 24 of the drill bit may be manufactured to any desired specification or given any desired characteristic(s). In this way, the cutting portion may be custom-engineered to possess optimal characteristics for drilling specific materials. For example, a hard, abrasion resistant matrix may be made to drill soft, abrasive, unconsolidated formations, while a soft ductile matrix may be made to drill an extremely hard, non-abrasive, consolidated formation. In this way, the bit matrix hardness may be matched to particular formations, allowing the matrix layer 16 to erode at a controlled, desired rate.

The height (A) of the drill bit crown (as shown in FIG. 2) can be extended to be longer than those currently known in the art while maintaining its structural integrity. Conventional crown heights are often limited to sixteen to seventeen millimeters or less because of the need to maintain the structural stability. In some embodiments of the present drill bits, the crown height A can be increased to be several times these lengths. In some circumstances, the crown height can range from about 1 to about 6 inches. In other circumstances, the crown height can range from about 2 to about 5 inches. In yet other circumstances, the crown height can be about 3 inches.

Figure 3B:
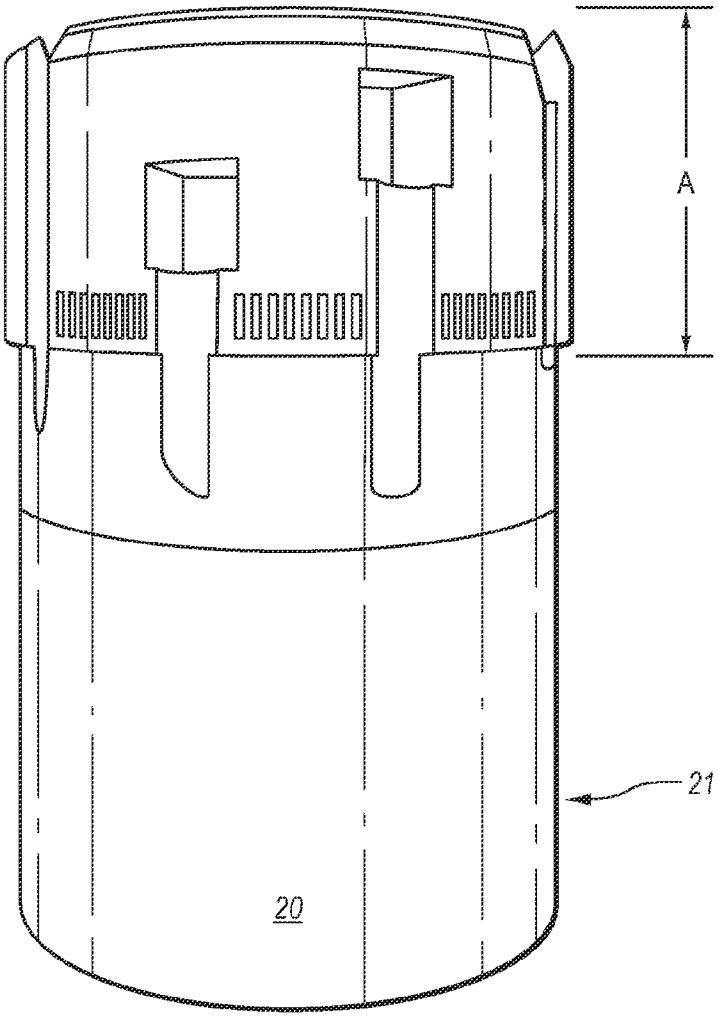
FIG. 3B shows an illustration of a side view of core drill bit with an extended cutting end height.
Figure 3A:
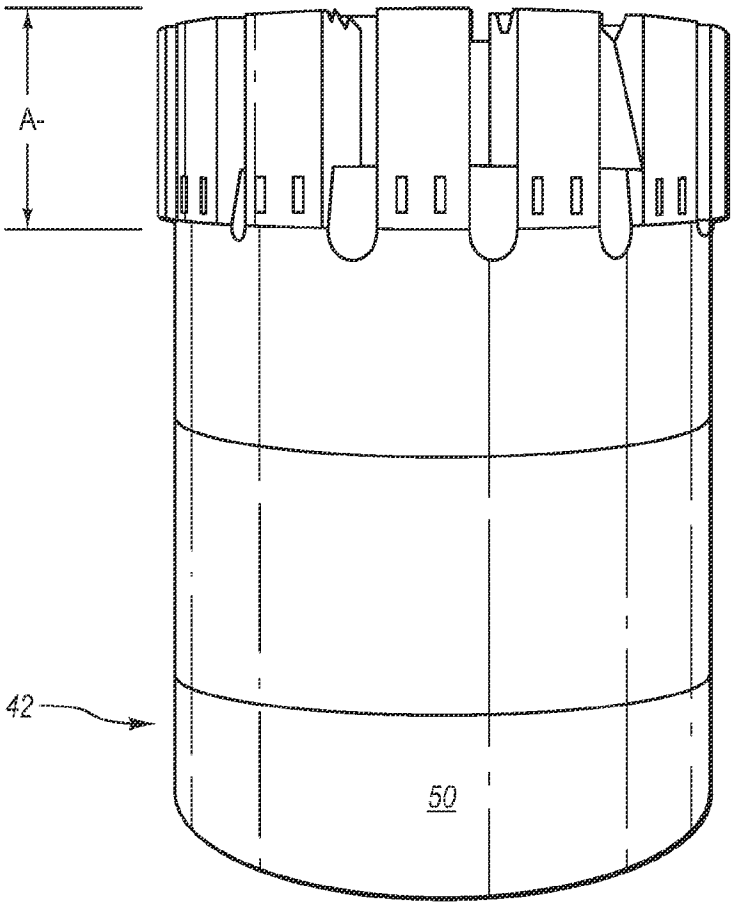
Fig. 3A (Prior Art)
FIG. 3A shows an illustration of a side view of an exemplary conventional core drill bit.

FIG. 3B illustrates one example of drill bit 20 with the extended crown height, while FIG. 3A illustrates a conventional core drill bit 40. As shown in FIGS. 3A-3B, the first section 21 of the drill bit 20 is roughly the same size as a corresponding first section 42 of the conventional drill bit 40. Nevertheless, the corresponding crown height (A-) of the conventional drill bit 40 is roughly half the height of the extended crown height A of the drill bit 20.

The cutting portion of the drill bit can contain a plurality of fluid/debris ways 28 and 32, as shown in FIG. 2. These fluid/debris ways may be located behind the proximal face 36 or along the length of the cutting portion 24 of the drill bit 20. Those fluid/debris ways located at the proximal face 36 will be referred to as notches, while those located behind the proximal face 36 will be referred to as slots 32. The fluid/debris ways may have different configurations to influence the hydraulics, fluid/debris flow, as well as the surface area used in the cutting action.

The cutting portion 24 may have any number of fluid/debris notches 28 that provides the desired amount of fluid/debris flow and also allows it to maintain the structural integrity needed. For example, FIG. 2 shows that the drill bit 20 may have three fluid/debris notches 28. In some embodiments, the drill bit may have fewer notches, such as two or even one fluid/debris notch. In other embodiments, though, the drill may have more notches, such as 3 or even 40 notches.

The fluid/debris notches 28 may be evenly or unevenly spaced around the circumference of the drill bit. For example, FIG. 2 depicts a drill bit that has three fluid/debris notches that are evenly spaced. In other situations, though, the notches 28 need not be evenly spaced around the circumference.

The fluid/debris notches 28 may have any shape that allows them to operate as intended. Examples of the types of shapes that the notches 28 can have include rectangular (as illustrated in FIG. 2), square, triangular, circular, trapezoidal, polygonal, elliptical, or any combination thereof. The fluid/debris notches 28 may have any width or length that allows them to operate as intended.

The fluid/debris notches 28 may have any size that will allow them to operate as intended. For example, a drill bit could have many small fluid/debris notches. In another example, a drill bit may have a few large fluid/debris notches and some small notches. In the example depicted in FIG. 2, for instance, the drill bit 20 contains just a few (3) large fluid/debris notches 28.

The fluid/debris notches 28 may be configured the same or differently. The notches 28 depicted in FIG. 2 are made with substantially the same configuration. But in other embodiments, the notches 28 can be configured with different sizes and shapes.

The fluid/debris notches 28 may also be placed in the cutting portion with any desired orientation. For example, the notches 28 may point to the center of the circumference of the drill bit. In other words, they may be perpendicular to the circumference of the drill bit. However, in other embodiments, the fluid/debris notches may be orthogonal to the circumference of the drill bit. In yet other embodiments, the notches may be offset proximally, distally, to the right, left, or any combination of these orientations.

The cutting portion 24 of the drill bit also contains one or more fluid/debris slot (or slots) 32. These slots 32 have an opening 10 on the outer surface 8 of the drill bit 20 and an opening 12 on the inner surface 4 of the drill bit 20. Because they are enclosed in the body of the crown, the fluid/debris slots 32 may be located in any part of the cutting portion 24 except the proximal face 36. As the cutting portion erodes away, the fluid/debris slots are progressively exposed as the erosion proceeds along the length of the crown. As this happens, the fluid/debris slots then become fluid/debris notches. In this manner, drill bits with such fluid/debris slots may have a continuous supply of fluid/debris ways until the extended crown is worn completely away. Such a configuration therefore allows a longer crown height while maintaining the structural integrity of the crown.

The cutting portion 24 may have any number of fluid/debris slots 32 that allows it to maintain the desired structural integrity. In some embodiments, the drill bit may have 0 to 20 slots. In other embodiments, though, the drill bit may contain anywhere from 1 to 3 slots. In the examples of the drill bit shown in FIG. 2, the drill bit 20 contains 6 fluid/debris slots 32.

The fluid/debris slots 32 may be evenly or unevenly spaced around the circumference of the drill bit. For example, FIG. 2 depicts a drill bit that has 6 slots that are evenly spaced. In other situations, though, the slots 32 need not be evenly spaced around the circumference.

The fluid/debris slots 32 may have any shape that allows them to operate as intended. Examples of the types of shapes that the slots can have include rectangular (as illustrated in FIG. 2), triangular, square, circular, trapezoidal, polygonal, elliptical, or any combination thereof. The fluid/debris slots 32 may have any width or length that allows them to operate as intended.

The fluid/debris slots 32 may have of any size that will allow them to operate as intended. For example, a drill bit could have many small fluid/debris slots. In another example, a drill bit may have a few large fluid/debris slots and some small slots. In the example depicted in FIG. 2, for instance, the drill bit 20 contains just large fluid/debris slots 32.

The fluid/debris slots 32 may be configured the same or differently. The slots 32 depicted in FIG. 2 are made with substantially the same configuration. But in other embodiments, the slots can be configured with different sizes and shapes. For example, the bit may have multiple rows of thin, narrow fluid/debris slots. In another example, the described drill bit may have a single row of tall, wide fluid/debris slots.

The fluid/debris slots 32 may also be placed in the cutting portion with any desired orientation. For example, the slots 32 may be oriented toward the center of the circumference of the drill bit and, therefore, may be perpendicular to the circumference of the drill bit. However, in other embodiments, the fluid/debris slots may be orthogonal to the circumference of the drill bit. In yet embodiments, the slots may be offset proximally, distally, to the right, left, or any combination thereof.

Figure 4:
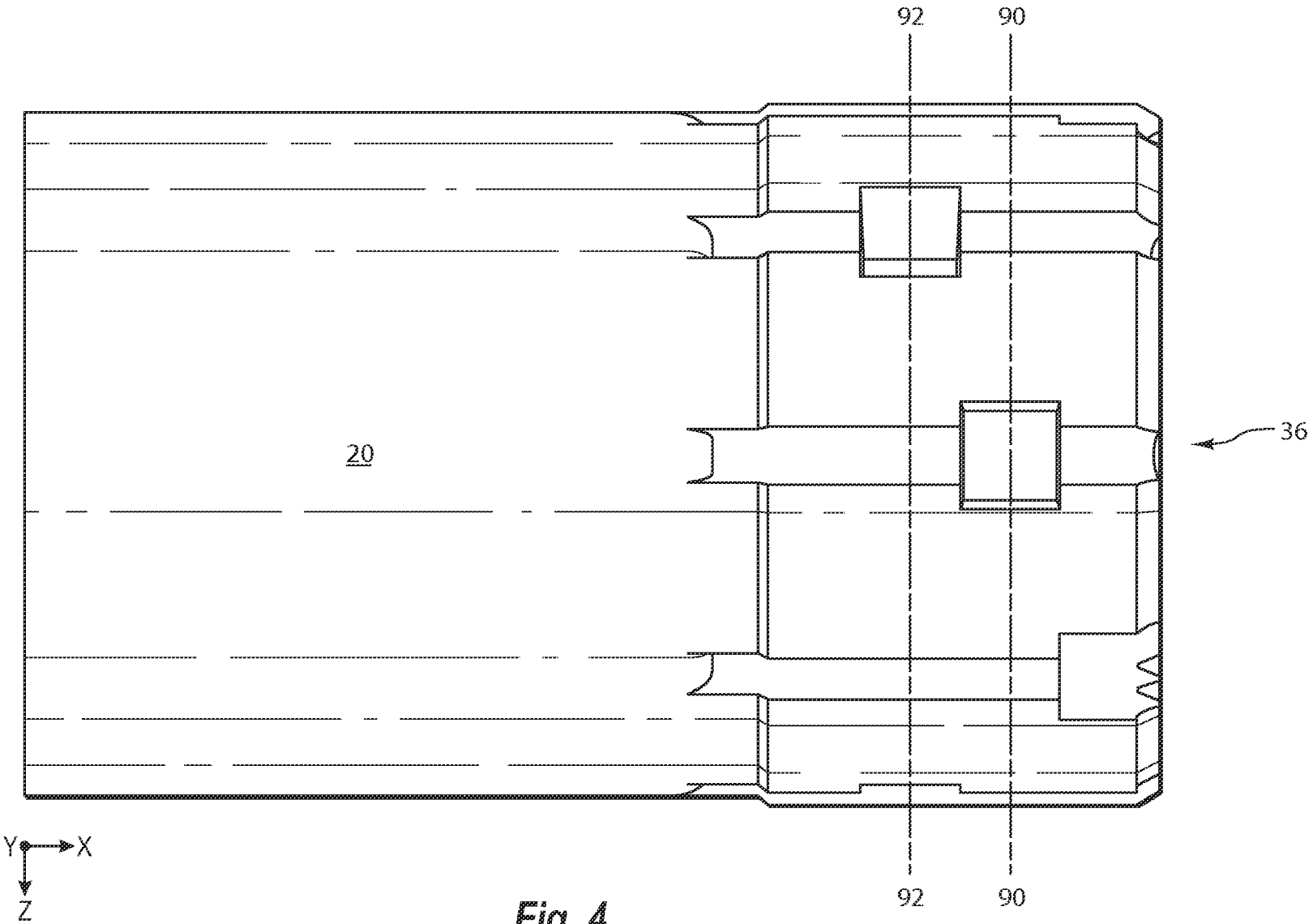
FIG. 4 shows an exemplary core drill bit with enclosed fluid/debris slots.

The drill bits may include one or multiple layer(s) (or rows) of fluid/debris slots, and each row may contain one or more fluid/debris slots. For example, FIG. 4 shows a drill bit that has six fluid/debris slots 32. In FIG. 4, the drill bit 20 has three fluid/debris slots in a first row 90. Further away from the proximal face 36, the drill bit 20 has a second row 92 of three more fluid/debris slots 32. As another example of six slots, the drill bit 20 could be configured to have 3 rows of two slots each, or even 6 rows of one slot each. The rows can contain the same or different number of slots. Also, the number of fluid/debris slots in each row may or may not be equal to the number of fluid/debris notches 28 in the proximal face 36 of the drill bit.

The first opening 10 of the fluid/debris slots (on the outer surface) may be larger or smaller (or have a different shape or size) than the second opening 12 on the inner surface. For example, the first opening could be a small trapezoidal shape and the second opening could have a larger, rectangular opening. In some embodiments, the first opening 10 and the second opening 12 of the fluid/debris slots 32 may be offset longitudinally or laterally from each other.

In some instances, a portion of the fluid/debris slots 32 may laterally overlap one or more fluid/debris notches. As well, a portion of a fluid/debris slot may laterally overlap another slot. Thus, before a fluid/debris slot (which has become a notch) erodes completely, the other fluid/debris slot is opened to become a notch, allowing the drill bit to continue to cut efficiently.

The fluid/debris slots may be placed in the drill bit in any configuration that provides the desired fluid dynamics. For example, in some embodiments, the fluid/debris slots may be configured in a staggered manner throughout the cutting portion of the drill bit. They may also be staggered with the fluid/debris notches. The slots and/or notches may be arranged in rows and each row may have a row of fluid/debris slots that are offset to one side of the fluid/debris slots and/or notches in the row just proximal to it. Additionally, even though the slots/notches may not be touching, they may overlap laterally as described above.

In some embodiments, the fluid/debris notches 28 and/or slots 32 may be configured in a stepped manner. Thus, each notch in the proximal face may have a slot located distally and to one side of it (i.e., to the right or left). Slots in the next row may then have another slot located distally to them and off to the same side as the slot/notch relationship in the first row.

In some embodiments, the fluid/debris notches and or slots may be configured in both a staggered and stepped manner as shown in FIG. 2. In that Figure, three fluid/debris notches 28 are located in the proximal face of the cutting portion 24 of the drill bit 20. Distally and in the clockwise direction of each fluid/debris notch, a corresponding fluid/debris slot is located and slightly laterally overlaps the notch. Distally and in the clockwise direction of these fluid/debris slots 32, a second set of fluid/debris slots 32 is located.

The cutting portion 24 may optionally contain flutes 40. These flutes may serve many purposes, including aiding in cooling the bit, removing debris, improving the bit hydraulics and making the fluid/debris notches and/or slots more efficient. The flutes may be placed in the drill bit in any configuration. In some embodiments, the flutes may be located on the outer surface and are therefore called outer flutes. In another embodiment, the flutes may be located on the inner surface and are therefore called inner flutes. In yet another embodiment, the flutes may be located in between the inner and the outer surface and are therefore face flutes. In still other embodiments, the flutes may be located in the drill bit in any combination of these flute locations. The size, shape, angle, number, and location of the flutes may be selected to obtain the desired results for which the flute(s) is used. The flutes may have any positional relationship relative to the fluid/debris notches and/or slots, including that relationship shown in FIG. 2. In the example provided below, an increase in the penetration rate was observed. This increased penetration rate was likely due to the increased bit face flushing, which may be due to the combination of larger waterways and the inner and outer diameter flutes.

The cutting portion 24 of the drill bit may have any desired crown profile. For example, the cutting portion of the drill bit may have a V-ring bit crown profile, a flat face bit crown profile, a stepped bit crown profile, or a semi-round bit crown profile. In some embodiments, the drill bit has the crown profile illustrated in FIG. 2.

In addition to the previously mentioned features, any additional feature known in the art may optionally be implemented with the drill bit 20. For example, the drill bit may have additional gauge protection, hard-strip deposits, various bit profiles, and combinations thereof. Protector gauges may be included to reduce the damage to the well's casing and to the drill bit as it is lowered into the casing. The first section of the drill bit may have hard-metal strips applied that may prevent the premature erosion. The drill bit may also optionally contain natural diamonds, polycrystalline diamonds, thermally stable diamonds, tungsten carbide, pins, cubes, or other gauge protection on the inner or outer surface of the core drill bit.

The drill bits described above can be made using any method that provides them with the features described above. The first section can be made in any manner known in the art. For instance, the first section (i.e., the steel blank) could be machined, sintered, or infiltrated. The second section can also be made in any manner known in the art, including infiltration, sintering, machining, casting, or the like. The notches 28 and slots 32 can be made in the second section either during or after such processes by machining, water jets, laser, Electrical Discharge Machining (EDM), and infiltration.

The first section 21 can then be connected to the second section 23 of the drill bit using any method known in the art. For example, the first section may be present in the mold that is used to form the second section of the drill bit and the two ends of the body may be fused together. Alternatively, the first and second sections can be mated in a separate process, such as by brazing, welding, or adhesive bonding.

The drill bits may be used in any drilling operation known in the art. As with other core drill bits, they may be attached to the end of a drill string, which is in turn connected to a drilling rig. As the core drill bit turns, it grinds away the materials in the subterranean formations that are being drilled. The matrix layer 16 and the fluid/debris notches 28 erode over time. As the fluid matrix layer 16 erodes, the fluid/debris slots 32 may be exposed and become fluid/debris notches. As more of the matrix layer erodes, additional fluid/debris slots are then exposed to become fluid/debris notches. This process continues until the cutting portion of a drill bit has been consumed and the drilling string need be tripped and the bit replaced.

Figure 5:
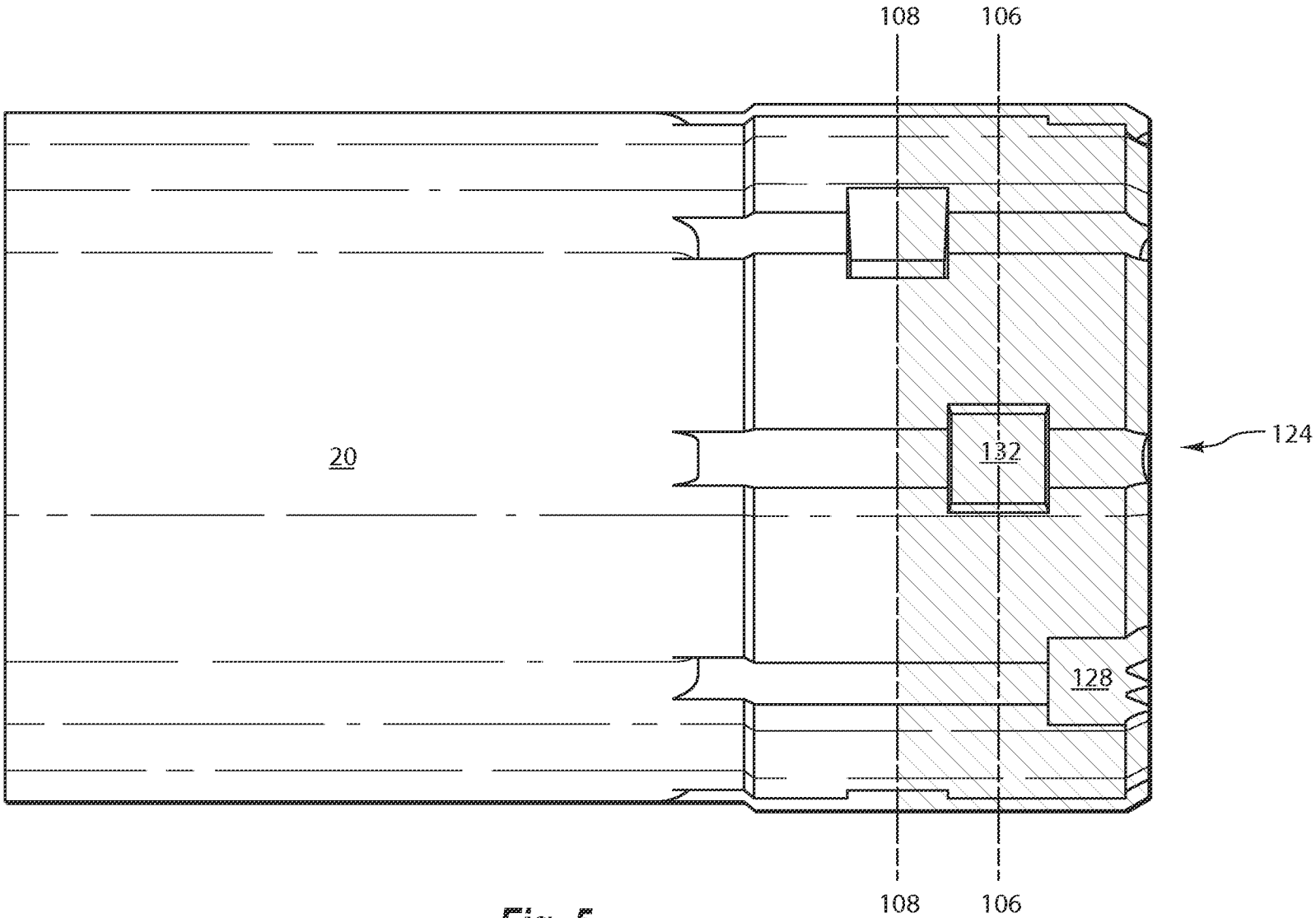
FIG. 5 shows a side view of an exemplary drill bit with an extended cutting-end height that has been eroded down, as depicted by hatching.

FIG. 5 shows one example of a worn drill bit 80. In that Figure, the entire row of fluid/debris notches 128 in the cutting portion 124 of the drill bit 80 has been eroded, as shown by the hatching. Additionally, a first row 106 of fluid/debris slots 132 has eroded. Thus, a second row 108 of fluid/debris slots 132 remains. Despite this erosion, the drill bit in this condition may still be used just as long as a conventional drill bit.

Using these drill bits described above provides several advantages. First, the height of the crown is increased beyond those lengths conventionally used without sacrificing structural integrity. Second, the usable life of the drill bit can be magnified by about 1.5 to about 2.5 times the normal usable life. Third, the drilling process becomes more efficient since less tripping in and out if the drill string is needed. Fourth, the penetration rate of the drill bits can be increase by up to about 25%. Fifth, the drill bit has consistent cutting parameters since the bit surface consistently replaces itself with a consistent cutting surface area.

The following non-limiting Example illustrates the drill bits and associated methods of using the drill bits.

EXAMPLE

Figure 6B:
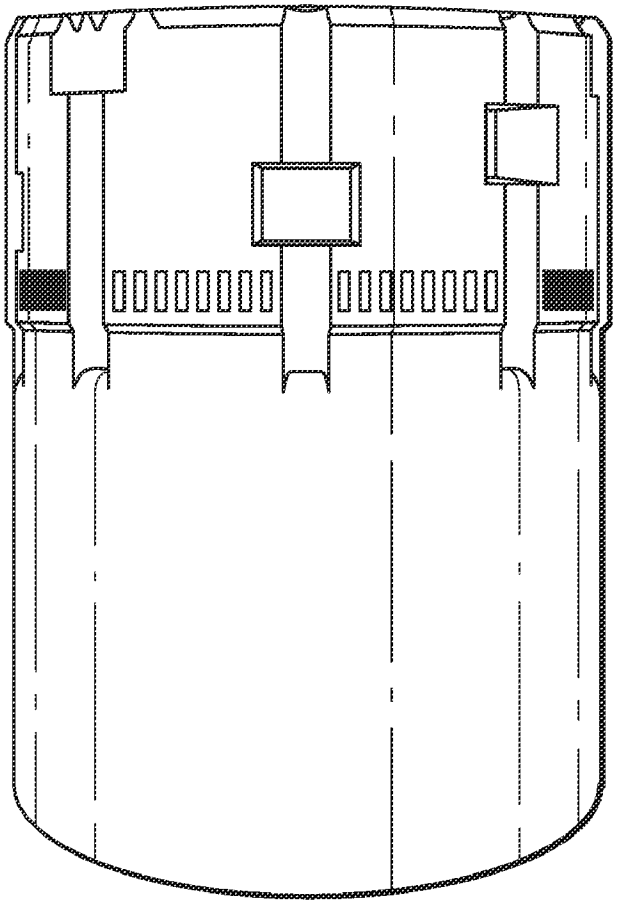
FIG. 6B shows an illustration a core drill bit with an extended cutting end height used in an exemplary drilling process.
Figure 6A:
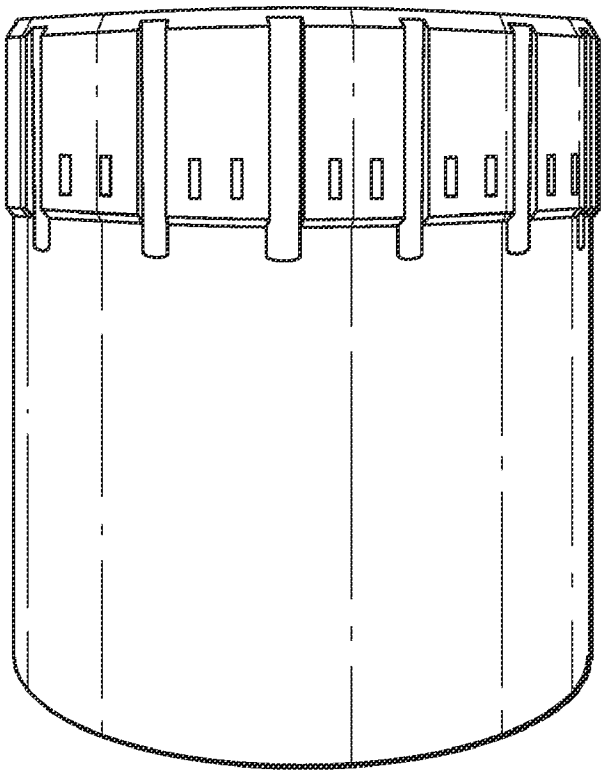
Fig. 6A (Prior Art)
FIG. 6A shows an illustration of a convention core drill bit used in an exemplary drilling process.

A first, conventional drill bit was obtained off-the-shelf. The first drill bit was manufactured to have an Alpha 7COM (Boart Longyear Co.) formulation and measured to have a crown height of 12.7 mm. The first drill bit had a bit size of 2.965" OD×1.875" ID (NQ). The first drill bit is depicted as Drill #1 in FIG. 6A.

A second drill bit was manufactured to contain the slots described above. The second drill bit was also made with an Alpha 7COM (Boart Longyear Co.) formulation, but contained six rectangular slots with a size of 0.520" wide by 0.470" high. The second drill bit was also manufactured with nine 0.125" diameter inner diameter flutes and nine 0.187" outer diameter flutes. The second drill bit was also manufactured with a crown height of 25.4 mm and a bit size of 2.965" OD×1.875" ID (NQ). The second drill bit is depicted as Drill #2 in FIG. 6B.

Both drill bits were then used to drill through a medium hard granite formation using a standard drill rig. The first drill bit was able to drill through 200 meters, at penetration rate of about 6-8 inches per minute, before the crown was worn out and needed to be replaced. The second drill bit was then used on the same drill rig to drill through similar material further down in the same drill hole. The second drill bit was able to drill through about 488 meters, at penetration rate of about 8-10 inches per minute, before the crown wore out and needed to be replaced.

The second drill bit was therefore able to increase the penetration rate by up to about 25%. As well, the usable life of the second drill bit was extended to be about 2.5 times longer that the comparable, conventional drill bit.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

We claim:

1. An in-ground, core drill bit, comprising:

a shank; and a crown including a first end secured to said shank, an opposing second end forming a cutting face, an inner surface, and an outer surface, said crown further including one or more enclosed fluid slots that radially extend from said inner surface to said outer surface and are formed in said crown a first distance from said cutting face, and one or more additional enclosed fluid slots that radially extend from said inner surface to said outer surface and are formed in said crown a second distance from said cutting face, wherein said second distance is greater than said first distance;

wherein said one or more enclosed fluid slots and said one or more additional enclosed fluid slots are configured to be progressively exposed to become fluid notches as said crown erodes during drilling.

2. The drill bit of claim 1, wherein said one or more additional enclosed fluid slots are circumferentially offset from said one or more enclosed fluid slots.

3. A method of making an in-ground core drill bit, comprising:

forming one or more enclosed fluid/debris slots into an annular crown at a first distance from a cutting face of said crown, said one or more enclosed fluid/debris slots extending from an inner surface of said crown to an outer surface of said crown;

forming one or more additional enclosed fluid/debris slots in said crown at a second distance from said cutting face that extend radially from said inner surface of said crown to said outer surface of said crown, wherein said second distance is greater than said first distance; and configuring said one or more enclosed fluid slots and said one or more additional enclosed fluid slots to be progressively exposed to become fluid notches as said crown erodes during drilling.

4. The method of claim 3, wherein forming one or more enclosed fluid/debris slots into an annular crown comprises forming one or more enclosed fluid/debris slots into an annular crown having a length ranging from about 1 inch to about 6 inches.

5. A method of core drilling, comprising:

attaching a core drill bit to a drill string, said core drill bit having an annular crown including an inner surface, an outer surface, a cutting face, one or more enclosed fluid slots that radially extend from said inner surface to said outer surface and that are formed in said crown a first distance from said cutting face, and one or more additional enclosed fluid slots that radially extend from said inner surface to said outer surface and are formed in said crown a second distance from said cutting face, wherein said second distance is greater than said first distance;

rotating said drill string to cause said core drill bit to penetrate an earthen formation; and causing said crown to erode thereby causing said one or more enclosed fluid slots to become fluid notches.

6. The method of claim 5, wherein said crown has a length ranging from about 1 inch to about 6 inches.

7. The method of claim 5, wherein said one or more additional enclosed fluid slots are circumferentially offset from said one or more enclosed fluid slots.

8. The method of claim 7, wherein said crown retains a substantially similar cutting profile throughout drilling.

9. The drill bit of claim 1, wherein said first distance extends from said cutting face to the center of said one or more enclosed fluid slots.

* * * * *